United States Patent [19]

Kauffman

[11] Patent Number: 4,628,546

[45] Date of Patent: Dec. 16, 1986

[54] COMMODE LID LOCKING DEVICE

[76] Inventor: Lexie A. Kauffman, 3900 Crestridge Dr., Midland, Tex. 79703

[21] Appl. No.: 719,811

[22] Filed: Apr. 4, 1985

[51] Int. Cl.[4] ..... A47K 13/24

[52] U.S. Cl. ..... 4/253

[58] Field of Search ..... 4/253; 292/288, 289, 292/193; 16/319

[56] References Cited

U.S. PATENT DOCUMENTS 2,651,053 9/1953 Rowe et al. ..... 4/253

2,698,439 1/1955 Bruckner ..... 4/253

4,479,273 10/1984 Raden et al. ..... 4/253

4,502,167 5/1985 Porzelius ..... 4/253

*Primary Examiner*—Charles E. Phillips

*Attorney, Agent, or Firm*—Harvey B. Jacobson

[57] ABSTRACT

A locking device for preventing unauthorized raising of a hinged toilet lid and the like by an infant comprises a blocking cylinder which is releasably secured to the toilet bowl between the lid hinge and the toilet tank. The diameter of the cylinder is such that it blocks substantial raising of the lid from the closed horizontal position. Quick-release attachment clips allow ready removal of the device by an adult when the toilet is to be used.

6 Claims, 6 Drawing Figures

COMMODE LID LOCKING DEVICE

BACKGROUND OF THE INVENTION

This invention relates to toilets, commodes and the like having hinged lids. More particularly, the invention provides a locking device for the hinged lid of a toilet bowl or the like for preventing unauthorized raising of the lid, for example, by an infant. Toilet bowl lids with no locking facility may be readily raised by an infant, thereby providing access to the bowl which can lead to accidents, such as the infant itself falling into the bowl or depositing articles in the bowl. The present invention is directing toward avoiding such accidents by preventing an infant obtaining access to the toilet bowl.

DESCRIPTION OF THE PRIOR ART

The following U.S. patents disclose toilet lid locking devices and the like, none of which, however, incorporate the features of the present invention: U.S. Pat. No. 2,651,053, Sept. 8, 1953; U.S. Pat. No. 2,698,439, Jan. 4, 1955; U.S. Pat. No. 2,996,731, Aug. 22, 1961; U.S. Pat. No. 3,024,472, Mar. 13, 1962; U.S. Pat. No. 4,060,861, Dec. 6, 1977;

SUMMARY OF THE INVENTION

The invention provides a locking device for a hinged toilet bowl lid and the like having advantageous features compared with prior art devices of this nature, included among which may be one or more of the following: namely, the device may be designed for ready removal by an adult when it is required to use the toilet; a holder may be provided for ready storage of the device when not in use; the device may be economically manufactured and may be made in vinyl or other plastic material making it simple to clean and thereby enhancing its hygienic qualities; the device is, at least in a preferred embodiment thereof, simple to install and remove; the device can be manufactured to have an unobtrusive attractive appearance and can be made in a variety of colors to suit the color of a particular toilet bowl.

In accordance with the invention, a locking device for a toilet bowl or the like having a hinged lid and a vertical surface (such as the front of a toilet tank) extending upwardly above the bowl behind the lid hinge comprises a blocking member, and means for releasably attaching the blocking member to the bowl in strategic location between the lid hinge and said vertical surface, whereby said member prevents, by interference, substantial raising of the lid toward said vertical surface from the closed substantially horizontal position of the lid.

In a preferred form of the invention, for example, the blocking member may comprise a cylinder of plastic material or the like, and the attaching means may comprise quick-release catches at opposite ends of the cylinder attachable to a base plate secured on the toilet bowl flange behind the lid hinge, so that the cylinder is disposed horizontally on the bowl in the rear corner between the lid hinge and said vertical surface in a manner preventing substantial raising of the lid.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
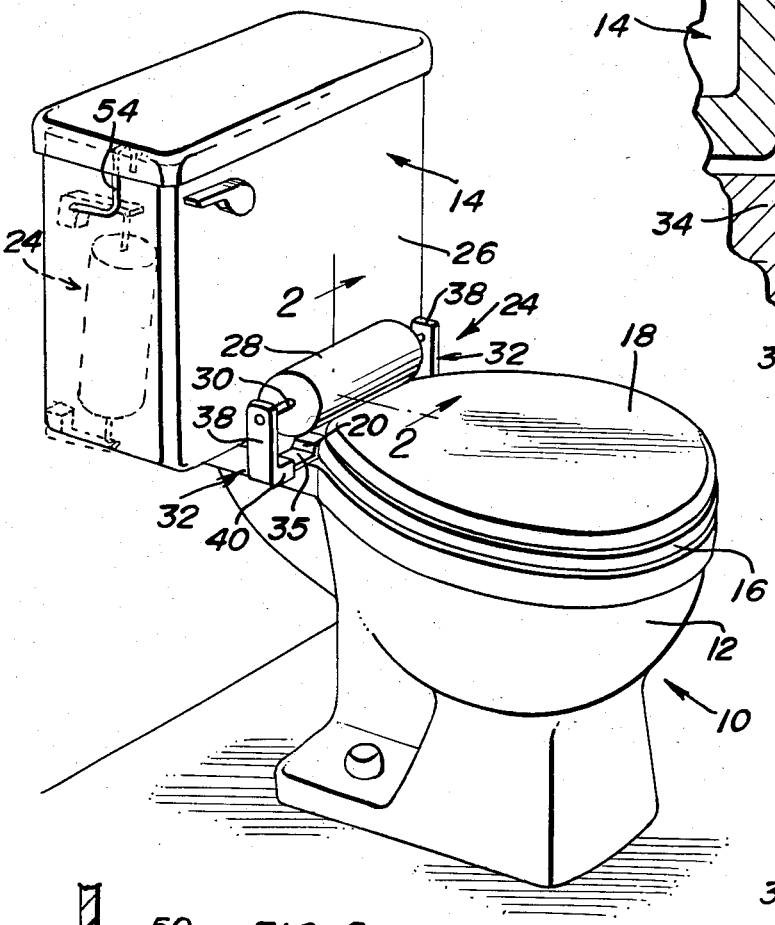
FIG. 1 is a perspective view of a toilet fitted with a locking device in accordance with the invention.
Figure 2:
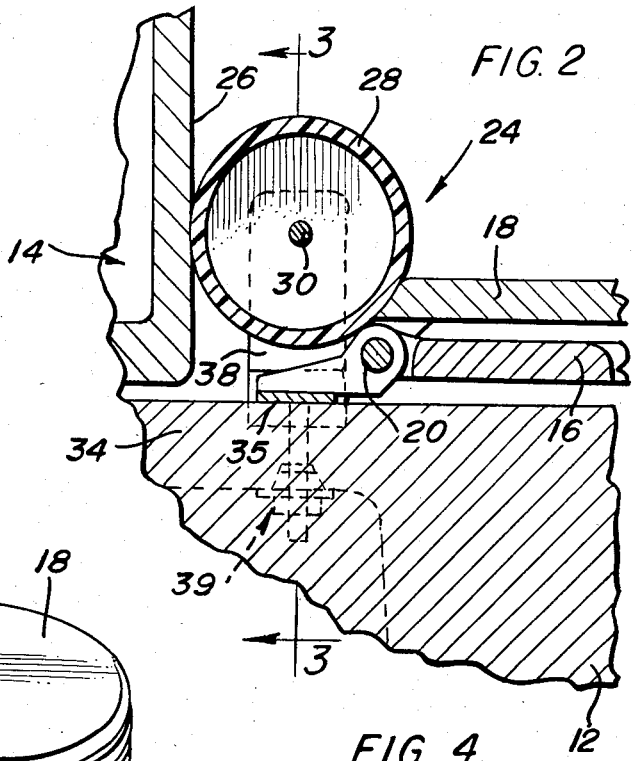
FIG. 2 is a sectional view, to an enlarged scale, on line 2—2 of FIG. 1.

FIG. 1 of the drawings show a conventional toilet 10 having a toilet bowl 12, a tank 14 above and behind the bowl, a hinged seat member 16, and a hinged lid 18, the seat member and lid being secured to the rear of the bowl by hinges 20. In accordance with the invention, the toilet is provided with a locking device 24 for preventing lid 18 from being raised from the closed or lowered position shown in FIGS. 1 and 2, thereby preventing an infant from obtaining unauthorized access to the bowl.

Locking device 24 comprises a detachable fitting which may readily be secured to the toilet between hinges 20 and vertical front surface 26 of tank 14, and which may be readily removed by an adult when use of the toilet is required. Device 24 comprises a blocking cylinder 28 carried on a support rod 30, and quick-release catches 32 at opposite ends of the rod 30 for releasably attaching the cylinder to a base plate 35 secured on flange 34 of the toilet bowl in a position behind hinges 20 whereby the cylinder effectively blocks substantial upward movement of lid 18. Plate 35 may, for example, have slots 37 whereby it is attached to the toilet bowl via bolt assemblies 39 that secure the lid and cover. The length of plate 35 is such that its ends project beyond the sides of flange 34 for receipt of the catches 32, and the ends of the plate are provided with holes 41 for retaining the catches as will be described.

Cylinder 28 may be of a washable vinyl or other plastic material and may be hollow (as illustrated) or solid. The rigidity of the cylinder should be sufficient to resist substantial compression by the lid when attempting to raise the lid, and the cylinder diameter related to the distance between hinges 20 and surface 28 should be such as to block substantial movement of the lid.

Figure 4:
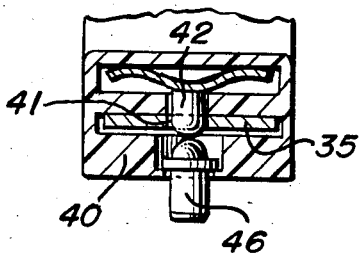
FIG. 4 is an enlarged sectional view on line 4—4 of FIG. 3.
Figure 6:
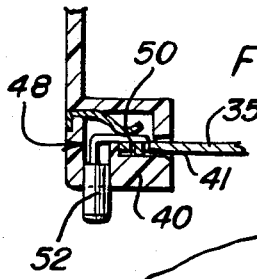
FIG. 6 is a sectional view of an alternative form of catch which may be used in the locking device.
Figure 5:
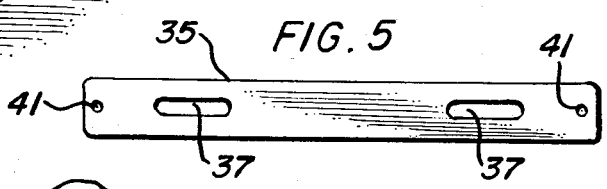
FIG. 5 is a plan view of a base plate for the locking device.
Figure 3:
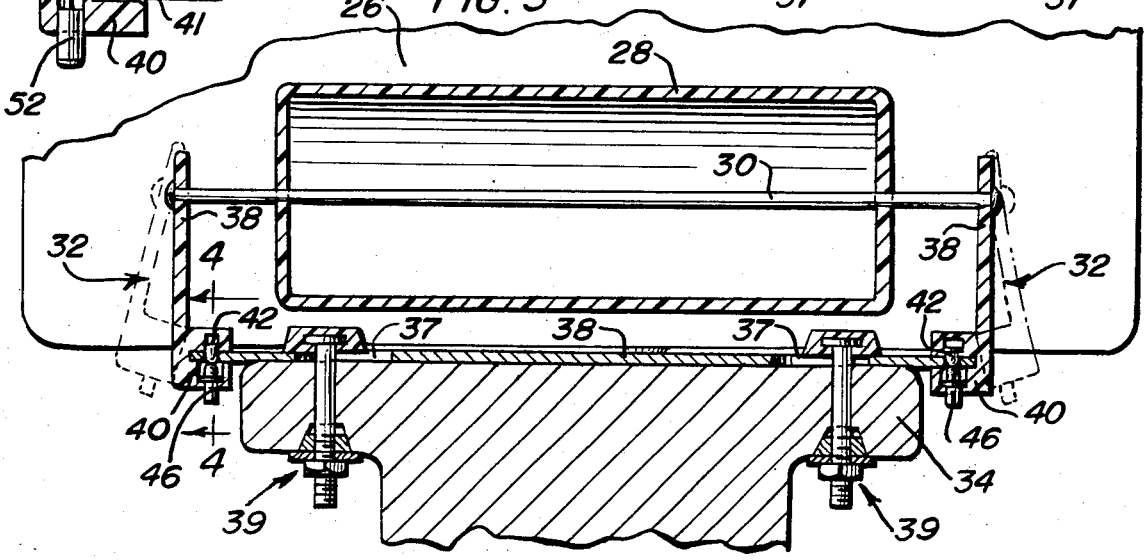
FIG. 3 is a sectional view on line 3—3 of FIG. 2.

Catches 32 may also be of molded plastic material and may have somewhat flexible vertical webs 38 and terminal horizontal portions 40. The length of webs 38 is related to the diameter of cylinder 28 to provide snug retention of the cylinder between lid 18 and tank 14, as shown in FIG. 3. Internally, the horizontal portions 40 of the catches may include catch elements adapted to snap into the holes 41 in plate 35 to releasably hold cylinder 28 on the plate. Thus, as shown in FIGS. 3 and 4, each catch may have an internal sprung button 42 and a cooperating lower button 46 projecting from the base of the cap. With this arrangement, button 46 snaps into engagement with a respective hole 41, and may be released by upward pressure on button 46 and outward flexure of web 38. An alternative catch device is shown in FIG. 6 wherein each catch may have a sprung internal catch element 48 with one limb 50 which snaps into the respective hole 41, and another limb 52 projecting below the catch to form a release button which is operated to remove the catch in the same manner as the previous arrangement.

It will be understood that the locking device may be readily applied to and removed from a toilet by an adult by means of the quick release catches, but the device provides protection against infants gaining access to the toilet bowl by raising the lid.

A hook 54 (FIG. 1) may be provided for hanging the locking device on the toilet tank when it is not in use. It will be appreciated that the locking device herein described exhibits the advantageous features previously indicated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A locking device for a toilet bowl or the like having a hinged lid with a hinge axis and a vertical surface extending upwardly behind the lid hinge, said device comprising an elongated cylindrical blocking member with a longitudinal axis, and attachment means for releasably securing the blocking member to the bowl in a position between the lid hinge and said vertical surface with the longitudinal axis substantially parallel to the hinge axis, said attachment means is connected at opposite ends of the cylinder for securing the cylinder horizontally on a flange of the toilet bowl behind the lid hinge in blocking relation with the lid, the blocking member being configured for preventing, by interference, substantial raising of the lid toward said vertical surface from a closed substantially horizontal position of the lid.

2. A locking device for a toilet bowl or the like having a hinged lid and a vertical surface extending upwardly behind the lid hinge, said device comprising a blocking member having opposite ends and a cross-dimension, and attachment means for releasably securing the blocking member to the bowl in a position between the lid hinge and said vertical surface, the blocking member being configured for preventing, by interference, substantial raising of the lid toward said vertical surface from a closed substantially horizontal position of the lid, wherein the attachment means comprises a base plate for attachment to the toilet bowl behind the lid and catch means at the opposite ends of the blocking member, the catch means comprising a vertical web portion having a height related to the cross dimension of the blocking member, and a horizontal portion for releasably clipping on one end of the base plate.

3. The invention of claim 2 including rod means extending from opposite ends of the blocking member, the catch means being mounted on said rod means.

4. The invention of claim 2 wherein each horizontal portion of each catch means includes a press-button released internal catch member for snapping into engagement with a hole formed in the end of the base plate for releasably retaining the catch means connected with the base plate.

5. The invention of claim 4 wherein the base plate has means for connecting same to the toilet bowl flange via bolt assemblies which connect the lid to the flange.

6. A locking device for preventing unauthorized opening of a hinged closure for an opening in a structure, said device comprising a blocking member and catch means at opposite ends of the member for releasably securing the member on the structure in juxtaposition to the closure hinge and in blocking relation with the closure, wherein said blocking member is of hollow cylindrical configuration with a longitudinal axis, wherein said structure includes a toilet commode having outwardly extending horizontal flanges extending from the bowl toward a water tank with the closure being the bowl lid with a hinge having a hinge axis being mounted on the flanges, said cylinder being positioned above the flanges adjacent and above the hinge axis to limit upward swinging movement of the lid toward the tank by obstructing the path of the lid when lifted and with the longitudinal axis substantially parallel to the hinge axis.

* * * * *